US006039799A

United States Patent [19]

Kawamura et al.

[11] Patent Number: 6,039,799

[45] Date of Patent: Mar. 21, 2000

[54] PAPER COATING COMPOSITION

[75] Inventors: Akira Kawamura, Toyonaka; Toshiyuki Hasegawa, Nara; Akira Tanikawa, Toyonaka, all of Japan

[73] Assignee: Sumitomo Chemical Company Limited, Osaka, Japan

[21] Appl. No.: 09/139,638

[22] Filed: Aug. 25, 1998

[30] Foreign Application Priority Data

Aug. 26, 1997 [JP] Japan ..... 9-229264
Aug. 4, 1998 [JP] Japan ..... 10-220667

[51] Int. Cl.[7] ..... C09D 7/12; C09D 201/00

[52] U.S. Cl. ..... 106/287.2; 106/150.2; 106/173.01; 106/200.2; 106/207.2; 106/208.2; 106/209.1; 524/86; 524/100

[58] Field of Search ..... 106/150.2, 173.01, 106/200.2, 207.2, 208.2, 209.1, 287.2; 524/86, 100

[56] References Cited

U.S. PATENT DOCUMENTS 5,767,176 6/1998 Nakanishi et al. ..... 523/404

*Primary Examiner*—David Brunsman
*Attorney, Agent, or Firm*—Pillsbury Madison & Sutro LLP

[57] ABSTRACT

A paper coating composition which comprises:

(I) a pigment, (II) an aqueous binder, and (III) a crosslinked amine compound obtainable by reacting a heterocyclic amine (a) and a glycidyl compound (b) having at least two glycidyl groups in the molecule, and a method for preparing the paper coating composition.

8 Claims, No Drawings

PAPER COATING COMPOSITION

FIELD OF THE INVENTION

The present invention relates to a paper coating composition which comprises a pigment and an aqueous binder. More precisely, the present invention provides a paper coating composition not generating formaldehyde and capable of providing excellent printing aptitude as well as printing effects. As used herein, the term "paper" has a broad sense including paper and cardboard named in a narrow sense.

A coating composition mainly composed of pigment and aqueous binder is applied to paper, which is then dried, and is subjected to required treatment such as calendar treatment to obtain a coated paper. The coated paper is characterized by its excellent printing effect, and hence finds wide use for commercial printed matter, magazine, book, and the like. However, with the trend toward higher required level of quality and faster printing, an effort is now under way to improve the quality of coated paper. Especially, in offset printing, which forms a large proportion of printing, the important problem for those skilled in the art is to improve and enhance the ink acceptability, water resistance such as wet picking under the influence of dampening water, and blistering resistance in rotary press printing.

To the foregoing problems, there are conventionally known techniques in which melamine-formaldehyde resin, urea-formaldehyde resin, polyamidepolyurea-formaldehyde resin as disclosed in JP-B-44-11667, JP-A-55-31837(=U.S. Pat. No. 4,246,153), block glyoxal resin as disclosed in JP-A-63-120197, and the like are added as water-resisting agent and additive for binder. However, both of the conventional water-resisting agent and additive for binder have effective advantages, while serious deficiencies or insufficient effect in a part of the characteristics are recognized. Therefore, they are not necessarily satisfactory in practical use.

For example, so-called aminoplast resin such as melamine-formaldehyde resin, and urea-formaldehyde resin have the following problems:

- a large amount of formaldehyde is formed when working, or from coated paper,
- the effect of improving the ink acceptability and blistering resistance cannot be almost obtained, and,
- when the pH of the coating composition is increased, it becomes difficult to exert a water resisting effect.

On the other hand, block glyoxal resin known as additive for binder containing no formaldehyde can impart the water resistance against dampening water to some degree, however, it has little effect on improvement in quality of coated paper such as ink acceptability and blistering resistance.

One object of the present invention is to provide paper coating compositions which can give higher quality to coated papers, such as high level of ink acceptability and water resistance, in order to meet demands on quality of coated papers, and do not generate formaldehyde.

As the result of extensive studies for solving the above described problems, the present inventors have discovered that a paper coating compositions comprising a pigment and an aqueous binder, as well as a compound obtainable by reacting specific compounds can provide papers with good properties. Thus, the present invention has been completed.

The present invention provide a paper coating composition which comprises:

(I) a pigment, (II) an aqueous binder, and (III) a crosslinked amine compound obtainable by reacting a heterocyclic amine (a) and a glycidyl compound (b) having at least two glycidyl groups in the molecule.

The pigment (I) as a component of the paper coating composition may be one conventionally used for general paper coating. Examples of the pigment include white inorganic pigments and white organic pigments. Examples of the white inorganic pigments include kaolin, talc, calcium carbonate (heavy or light), aluminum hydroxide, satin white and titanium oxide. Examples of the white organic pigment include polystyrene, melamine-formaldehyde resin and urea-formaldehyde resin. These pigments can be used independently or in combination of two or more.

The aqueous binder may also be one conventionally used for general paper coating. Examples of the aqueous binder include water soluble binders and aqueous emulsion binders. Examples of the water soluble binders include unmodified or modified starches such as oxidized starch and starch phosphate, polyvinyl alcohol, water soluble proteins such as casein and gelatin and modified cellulose such as carboxymethyl cellulose. Examples of the aqueous emulsion binders include styrene-butadiene resin containing carboxyl group, vinyl acetate resin, ethylene-vinyl acetate resin and methyl methacrylate resin. The aqueous binders can be used independently or in combination of two or more.

The crosslinked amine compound (III) for use in the present invention is obtainable by allowing a heterocyclic amine (a) and a glycidyl compound (b) having at least two glycidyl groups in the molecule to react. The heterocyclic amine (a) herein used is a cyclic compound having at least one nitrogen atom in addition to carbon atoms as ring formation atom. The atom constituting a heterocycle is not limited to carbon and nitrogen, and, in addition, heteroatoms such as oxygen and sulfur are capable of constituting the ring. Also, the compound, which contains a heterocycle having nitrogen as ring atom, may also contain aliphatic hydrocarbon group, alicyclic hydrocarbon group, aromatic hydrocarbon group, acyl group and the like. Further, through these hydrocarbon groups, amino groups different from cyclic amino groups, and other substituents such as halogen may be attached thereto.

Examples of the heterocyclic amine (a) include heterocyclic monoamines such as piperidine, 2-, 3-, or 4-pipecoline, and 2,4-, 2,6-, or 3, 5-lupetidine; heterocyclic diamines such as piperazine, homopiperazine, N-alkyl (for example, methyl, ethyl, or propyl)piperazine, N-methyl homopiperazine, N-acyl (for example acetyl)piperazine, N-acyl (for example, acetyl)homopiperazine and 1-(chlorophenyl)piperazine; and heterocyclic amine to which is attached aminoalkyl such as N-aminoalkyl (for example, ethyl or propyl)piperidine, N-aminoalkyl (for example, ethyl or propyl)piperazine, N-aminoalkyl (for example, ethyl or propyl)morpholine, N-aminopropyl-2-, or -4-pipecoline, and 1,4-bisaminopropylpiperazine. Among them, piperidine, piperazine, N-aminoethylpiperazine, 1,4-bisaminopropylpiperazine, and the like are advantageous industrially. Each of the heterocyclic amines (a) can be used singly, or in combination of two or more kinds thereof.

It is advantageous for the heterocyclic amine (a) to have at least one primary or secondary amino group in view of reactivity with the glycidyl compound. Especially, it is advantageous to have at least one primary amino group in addition to secondary or tertiary amino groups constituting a heterocycle. In particular, when a compound in which aminoalkyl is attached to a heterocycle having nitrogen as ring atom such as N-aminoethylpiperazine and 1,4-bisaminopropylpiperazine is used singly, or in combination with other amine, excellent effect is exerted.

The glycidyl compound (b) to be allowed to react with the heterocyclic amine (a) has at least two glycidyl groups in the molecule. The group linking a plurality of the glycidyl groups is not specifically limited, and any of aliphatic, aromatic, or alicyclic group, or the like may be employed. Examples of the glycidyl compound (b) include alkylene glycol diglycidyl ethers such as ethylene glycol diglycidyl ether and propylene glycol diglycidyl ether; polyoxyalkylene glycol diglycidyl ethers such as polyethylene glycol diglycidyl ether and polypropylene glycol diglycidyl ether; aromatic diglycidyl ethers such as resorcin diglycidyl ether and bisphenol A diglycidyl ether; trimethylol propane di-, or tri-glycidyl ether, sorbitol di-, tri-, tetra-, penta, or hexa-glycidyl ether, and pentaerythritol di-, tri-, or tetra-glycidyl ethers. Each of the glycidyl compounds (b) can be used singly, or in combination of two or more kinds thereof. Among them, an aromatic glycidyl ethers is advantageously used.

The glycidyl compound (b) is used generally in an amount in the range of 0.1 to 1 mol, preferably in the range of 0.3 to 0.8 mol, and more preferably in the range of 0.5 to 0.8 mol, for every 1 mol of the heterocyclic amine (a). Even when a plurality of reactive primary or secondary amino groups are present in the heterocyclic amine (a), an increase in amount of the glycidyl compound (b) accelerates the gelation of the reaction product. Therefore, it is adequate that the mole ratio of the glycidyl compound (b) to the heterocyclic amine (a) is set at 1 or less regardless of the number of amino groups. The reaction between the heterocyclic amine (a) and the glycidyl compound (b) can be carried out without a solvent, or in a solvent. This reaction is carried out generally at temperatures of about 30 to 100° C. Preferable temperature varies depending on the absence or presence of the solvent, or on the kind of solvent. When a mixture of water and an organic solvent is used as the solvent, the preferable temperature is about 40 to 90° C. When an organic solvent not containing water is used, the preferable temperature is about 40 to 70° C. The reaction time is usually for approximately 1 to 20 hours. This reaction proceeds even without a catalyst, while basic catalysts such as ammonia and caustic soda may be present.

In this reaction, a reaction between the amino group in the heterocyclic amine (a) and the glycidyl group in the glycidyl compound (b) is most predominant. The reaction products have diverse structures depending on the proportion between the heterocyclic amine (a) and glycidyl compound (b) to be used, the kind of the glycidyl compound (b), and further the kind of the heterocyclic amine (a). The reaction products may be also low polymers having a certain degree of molecular weight distribution. Representing the glycidyl compound (b) having two glycidyl groups (abbreviated as Gly) by the formula of Gly-R-Gly main reaction process is illustrated below.

When the heterocyclic amine (a) is a heterocyclic monoamine having no additional amino group, representing it by the formula of HN=Cyc1 (Cyc1 denotes a residue excluding an amino group from the heterocyclic monoamine), the following reaction proceeds to form an amine-epoxy addition product. However, the one of a structure in which only one molecule of heterocyclic amine is added to the glycidyl compound can be also formed partially.

2HN=Cyc1+Gly-R-Gly→Cyc1=N—CH2CH(OH)CH2-R—CH2CH(OH)CH2-N=Cyc1

When the heterocyclic amine (a) is a heterocyclic diamine having no additional amino group, representing it by the formula of HN=Cyc2=NH (Cyc2 denotes a residue excluding two amino groups from the heterocyclic diamine), the following reaction proceeds mainly. However, a glycidyl compound can also be added to a secondary amino group in the following reaction product, resulting a different structure.

HN=Cyc2=NH+Gly-R-Gly→HN=Cyc2=N—CH2CH(OH)CH2-R-Gly

HN=Cyc2=N—CH2CH(OH)CH2-R-Gly+HN=Cyc2=NH→HN=Cyc2=N—CH2CH(OH)CH2-R-CH2CH(OH)CH2-N=Cyc2=NH

When the heterocyclic amine (a) has a primary or secondary amino group other than the heterocycle, when plural kinds of the heterocyclic amines (a) are used in combination, or when the glycidyl compound has three or more glycidyl groups, the reaction becomes more complicated. However, in any cases, compounds in which a plurality of amine molecules are mutually crosslinked are formed predominantly. For example, when the heterocyclic amine (a) has one primary amino group in addition to the heterocycle, assuming that it is expressed as R1-NH2, the following reaction proceeds mainly. However, a glycidyl compound can also be added to a secondary amino group in the following reaction product, resulting a different structure.

R1—NH2 + Gly—R—Gly → R1—NH—CH2CH(OH)CH2—R—Gly
R1—NH—CH2CH(OH)CH2—R—Gly + R1—NH2 →
R1—NH—CH2CH(OH)CH2—R—CH2CH(OH)CH2—NH—RL

As described above, the crosslinked amine compound (III) can be a low polymer having a certain degree of molecular weight distribution depending on the structure of the heterocyclic amine (a) as starting material. The molecular weight thereof may be those resulting in that the viscosity of the 50 wt % solution thereof at 25° C. falls in the range of 10 to 30,000 mPa.s. Especially, it is preferable that the viscosity is 30 mPa.s or more, and more preferably it is 50 mPa.s or more and 25,000 mPa.s or less.

The crosslinked amine compound (III), i.e., reaction product between the heterocyclic amine (a) and the glycidyl compound (b), is used for preparation of a composition for coating paper as a solution or a dispersion in a liquid medium. That is, the heterocyclic amine (a) and the glycidyl compound (b) are allowed to react with each other in a liquid medium (solvent). Alternatively, the heterocyclic amine (a) and the glycidyl compound (b) are allowed to react with each other, and then, liquid medium is added thereto to dissolve or disperse the reaction product. This results in a solution or dispersion liquid of crosslinked amine compound to be a component for the composition for coating paper of the present invention.

Any liquid mediums are acceptable as long as the crosslinked amine compound (III) can be dissolved or homogeneously dispersed therein. They can be water and/or an organic solvent. Examples of organic solvent include monohydric alcohols such as methanol, ethanol, 1-, or 2-propanol, 1-, or 2-butanol, 1-pentanol, 3-methyl-1-butanol, 1-hexanol, 4-methyl-2-pentanol, 2,4-dimethyl-3-pentanol, 2,6-dimethyl-4-heptanol, 2-ethyl-1-hexanol, 1-, or 2-octanol, lauryl alcohol, cyclohexanol, and benzyl alcohol; polyhydric alcohols such as 1,2-ethanediol, 1,2-propanediol, and 1,2,3-propanetriol; ethers having alcoholic hydroxyl groups such as furfuryl alcohol, tetrahydrofurfuryl alcohol, ethylene glycol monomethyl ether, ethylene glycol monoethyl ether, ethylene glycol monobutyl ether, diethylene glycol, diethylene glycol monomethyl ether, diethylene glycol monoethyl ether, diethylene glycol monobutyl ether, and triethylene glycol; keto-alcohols such as 4-hydroxy-4-methyl-2-pentanone; ethers such as diethyl ether, dipropyl ether, diisopropyl ether, dibutyl ether, β,β'-dichlorodiethyl ether, 1,4-dioxane, diethyl cellosolve, and dibutyl carbitol; aldehydes such as butyl aldehyde; hydrocarbons such as cyclohexane, hexane, heptane, toluene, o-, m-, or p-xylene; organic halogen compounds such as 1,1,1-trichloroethane, trichloroethylene, 1-, or 2-bromopropane, 1-bromobutane, lauryl bromide, 1,3-dibromopropane, 1,4-dibromobutane, 1,5-dibromopentane, 1-bromo-3-chloropropane, and 2,3-dibromo-1-propanol; ketones such as acetone, 2,4-pentanedione, methyl ethyl ketone, 2-, or 3-pentanone, 3-methyl-2-butanone, methyl isobutyl ketone, 2-heptanone, 2,6-dimethyl-4-heptanone, 2,4-dimethyl-3-pentanone, cyclohexanone, mesityl oxide, and isophorone; esters such as methyl acetate, ethyl acetate, propyl acetate, isopropyl acetate, butyl acetate, sec-butyl acetate, isobutyl acetate, amyl acetate, benzyl acetate, ethyl propionate, butyl propionate, amyl propionate, methyl benzoate, ethyl benzoate, diethyl malonate, diethyl oxalate, butyl phosphate, and ethyl acetoacetate. Each of them can be used singly, or in combination of two or more kinds thereof. Especially, benzyl alcohol is excellent in solubility, dispersibility, and safety, and it is advantageously used singly, or in combination with other organic solvents.

Preferably, the liquid medium is water alone or a mixture of water and organic solvent. However, in many cases case, the glycidyl compound (b), a raw material of the crosslinked amine compound (III), is hardly dissolved in water alone. In such case, a mixture of water and an organic solvent is used as the solvent for reaction between the heterocyclic amine (a) and the glycidyl compound (b), and the reaction solvent is used as the liquid medium for the crosslinked amine compound (III). The content of water in the reaction mass is preferably 20% by weight or less, more preferably 10% by weight or less, since an epoxy resin insoluble to water and to the organic solvent is produced due to a polymerization of the glycidyl compounds (b), when the water content is too high. After completion of the reaction, water may be added to the reaction solvent, in order to lower the content of organic solvent in the liquid medium, in which the crosslinked amine compound (III) is dissolved or dispersed.

Any proportions between an organic solvent and water in the liquid medium, in which the crosslinked amine compound (III) is dissolved or dispersed, can be adopted. Usually, they are used in the proportions of 1 to 100 wt % for water to 99 to 0 wt % for organic solvent, and preferably in the proportions of 3 to 50 wt % for water to 97 to 50 wt % for organic solvent. Some of organic solvents are not miscible with water. However, due to the presence of the crosslinked amine compound (III) according to the present invention, presumably owing to its acts as a surfactant, the organic solvents become almost homogeneously miscible with water.

A liquid medium for the crosslinked amine compound (III) consisting substantially of water alone can be prepared by a method in which reaction between a heterocyclic amine (a) and a glycidyl compound (b) is conducted in an organic solvent, and, after completion of the reaction, the organic solvent is distilled out and water is added to the reaction mass. In this method, it is preferable that the glycidyl compound (b) is dissolved in a ketone, the heterocyclic amine (a) is dissolved in a hydrophilic solvent, other than ketones, and, thereafter, both solutions are mixed to conduct the reaction. Examples of the ketone, solvent for the glycidyl compound (b), include the ketones exemplified above as a liquid medium for the crosslinked amine compound (III). Among them, acetone id preferred. Examples of the hydrophilic solvent, other than ketones, solvent for the heterocyclic amine (a), include the hydrophilic solvent, other than ketones, exemplified above as a liquid medium for the crosslinked amine compound (III). Among them, monohydric and polyhydric alcohols, particularly methanol, is industrially advantageously used.

Distilling out of the solvent, after completion of the reaction, is generally conducted by a distillation under normal atmospheric pressure, but it may be conducted by a distillation under reduced pressure or by a steam distillation. Two or more kind of the methods can be combined. For example, a steam distillation may be conducted after a distillation under normal atmospheric pressure. In the case of a distillation under normal atmospheric pressure, it is preferably conducted at a temperature between the boiling point of the solvent and 100° C., more preferably 60° C., in order to avoid coloration of the crosslinked amine compound (III).

Addition of water after the solvent being distilled out is preferably conducted at a temperature between 50–120° C. If the temperature is too low, difficulty in dissolution by water may be caused, since viscosity of the crosslinked amine compound (III), after the solvent being distilled out, is very high. If the temperature is too high, there is a risk of bumping.

The crosslinked amine compound (III) thus obtained is mixed with pigment (I) and aqueous binder (II) to prepare a paper coating composition. In preparing the paper coating composition of the present invention, the composition proportion of pigment (I) and aqueous binder (II) is determined in accordance with the use and object thereof, and is not different from the composition commonly adopted by those skilled in the art. Usually, the aqueous binder (II) is contained preferably on the order of 1 to 200 parts by weight, and more preferably on the order of 5 to 50 parts by weight based on every 100 parts by weight of the pigment (I). The crosslinked amine compound (III) is mixed, on a solid content basis, preferably on the order of 0.01 to 0.3 parts by weight, and more preferably on the order of 0.05 parts by weight or more and 0.2 parts by weight or less based on every 100 parts by weight of pigment (I).

In the preparation of the paper coating composition, the order of adding and mixing the pigment (I), the aqueous binder (II) and the crosslinked amine compound (III) is not critical and is not particularly limited. In an example, the crosslinked amine compound (III) dissolved or dispersed in a liquid medium is may be added and mixed to a mixture of the pigment (I) and the aqueous binder (II), or the crosslinked amine compound (III) may be added and mixed beforehand to the pigment (I) or the aqueous binder (II) and then the rest of component be combined.

The paper coating composition of the present invention may comprise another resin component such as another water resistant agent or printability improver, in addition to the crosslinked amine compound (III). The paper coating composition of the present invention may further contain other components such as dispersant, viscosity/flowability modifier, antifoamer, preservative, lubricant, water retention agent and colorant i.e. dye, color pigment or the like.

The paper coating composition of the present invention may be applied on a paper by conventional means including methods using various known coaters such as blade coater, air knife coater, bar coater, size press coater gate roll coater and cast coater. Thereafter, the paper is subjected to the necessary drying step and, if necessary, smoothing step using a supercalender or the like to finish a coated paper.

EXAMPLES

The present invention will now be described in more detail by means of Examples, which should not be construed as a limitation upon the scope of the present invention. In Examples, % and part used for indicating content or amount are of weight basis unless otherwise specified. Viscosity and pH were measured at 25° C.

Synthetic Example 1

Into a four-necked flask equipped with a thermometer, a reflux condenser and a stirrer were charged 38.7 g (0.30 mole) of N-(2-aminoethyl)piperazine and 25.3 g of water. Maintaining the inner temperature at 65–75° C., whole of a solution prepared by mixing 60.2 g (0.177 mole) of bisphenol A diglycidyl ether and 105.8 g of benzyl alcohol beforehand was slowly added dropwise thereto. After completion of the drop wise addition, the reaction was conducted for additional 4 hours at an inner temperature of 70° C. to give a solution of a crosslinked amine compound having a concentration of 50%, pH of 14.5 and a viscosity of 960 mPa.s.

Synthetic Example 2

Into a vessel same to that used in Synthetic Example 1 was charged 38.7 g (0.30 mole) of N-(2-aminoethyl) piperazine. Maintaining the inner temperature at 65–75° C., whole of a solution prepared by mixing 55.1 g (0.162 mole) of bisphenol A diglycidyl ether, 86.3 g of benzylalcohol and 7.5 g of water beforehand was slowly added dropwise thereto. After completion of the dropwise addition, the reaction was conducted for additional 4 hours at an inner temperature of 70° C. to give a solution of a crosslinked amine compound having a concentration of 50%, pH of 12.9 and a viscosity of 2940 mPa.s.

Synthetic Example 3

Into a vessel same to that used in Synthetic Example 1 were charged 60.1 g (0.3 mole) of 1,4-bis(3-aminopropyl) piperazine and 9.2 g of water. Maintaining the inner temperature at 65–75° C., whole of a solution prepared by mixing55.1 g (0.162 mole) of bisphenol A diglycidyl ether and 106.0 g of benzylalcohol beforehand was slowly added dropwise thereto. After completion of the dropwise addition, the reaction was conducted for additional 4 hours at an inner temperature of 70° C. to give a solution of a crosslinked amine compound having a concentration of 50%, pH of 14.1 and a viscosity of 6590 mPa.s.

Synthetic Example 4

Into a vessel same to that used in Synthetic Example 1 were charged 34.0 g (0.4 mole) of piperidine and 8.8 g of water. Maintaining the inner temperature at 65–75° C., whole of a solution prepared by mixing 73.5 g (0.216 mole) of bisphenol A diglycidyl ether and 98.9 g of benzylalcohol beforehand was slowly added dropwise thereto. After completion of the dropwise addition, the reaction was conducted for additional 4 hours at an inner temperature of 70° C. to give a solution of a crosslinked amine compound having a concentration of 50%, pH of 13.9 and a viscosity of 197 mPa.s.

Synthetic Example 5

Into a vessel same to that used in Synthetic Example 1 were charged 64.6 g (0.50 mole) of N-(2-aminoethyl) piperazine and 77.9 g of methanol. Maintaining the inner temperature at 45–55° C., whole of a solution prepared by mixing 91.3 g (0.268 mole) of bisphenol A diglycidyl ether and 77.9 g of acetone beforehand was slowly added dropwise thereto. After completion of the drop wise addition, the reaction was conducted for additional 4 hours at an inner temperature of 45–55° C. Then, the reflux condenser was replaced with a liebig condenser, and the inner temperature was raised to 120° C. while distilling acetone and methanol out of the reaction mass. Thereafter, adding 188.6 g of water slowly, the reaction mass was cooled to give a solution of a crosslinked amine compound having a concentration of 50%, pH of 12.4 and a viscosity of 1839 mPa.s.

Synthetic Example 6

Into a vessel same to that used in Synthetic Example 1 were charged 90.5 g (0.701 mole) of N-(2-aminoethyl) piperazine and 96.5 g of methanol. Maintaining the inner temperature at 45–55° C., whole of a solution prepared by mixing 102.4 g (0.301 mole) of bisphenol A diglycidyl ether and 96.5 g of acetone beforehand was slowly added dropwise thereto. Then, the reaction and distilling solvent out were conducted according to the same manner as those in Synthetic Example 5. Thereafter, adding 233.7 g of water slowly, the reaction mass was cooled to give a solution of a crosslinked amine compound having a concentration of 50%, pH of 12.2 and a viscosity of 560 mPa.s.

Synthetic Example 7

Into a vessel same to that used in Synthetic Example 1 were charged 75.6 g (0.586 mole) of N-(2-aminoethyl) piperazine and 96.6 g of methanol. Maintaining the inner temperature at 45–55° C., whole of a solution prepared by mixing 117.6 g (0.346 mole) of bisphenol A diglycidyl ether and 96.6 g of acetone beforehand was slowly added dropwise thereto. Then, the reaction and distilling solvent out were conducted according to the same manner as those in Synthetic Example 5. Thereafter, adding 236.4 g of water slowly, the reaction mass was cooled to give a solution of a crosslinked amine compound having a concentration of 50%, pH of 12.1 and a viscosity of 3980 mPa.s.

Synthetic Example 8

Into a vessel same to that used in Synthetic Example 1 were charged 90.4 g (0.700 mole) of N-(2-aminoethyl) piperazine and 96.5 g of methanol. Maintaining the inner temperature at 45–55° C., whole of a solution prepared by mixing 159.7 g (0.469 mole) of bisphenol A diglycidyl ether and 125.0 g of acetone beforehand was slowly added dropwise thereto. Then, the reaction and distilling solvent out were conducted according to the same manner as those in Synthetic Example 5. Thereafter, adding 282.5 g of water slowly, the reaction mass was cooled to give a solution of a crosslinked amine compound having a concentration of 50%, pH of 11.6 and a viscosity of 23350 mPa.s.

Synthetic Example 9

Into a vessel same to that used in Synthetic Example 1 were charged 92.4 g (0.715 mole) of N-(2-aminoethyl) piperazine and 59.1 g of methanol. Maintaining the inner temperature at 45–55° C., whole of a solution prepared by mixing 104.6 g (0.307 mole) of bisphenol A diglycidyl ether and 137.9 g of acetone beforehand was slowly added dropwise thereto. Then, the reaction and distilling solvent out were conducted according to the same manner as those in Synthetic Example 5. Thereafter, adding 236.6 g of water slowly, the reaction mass was cooled to give a solution of a crosslinked amine compound having a concentration of 50%, pH of 12.5 and a viscosity of 484 mPa.s.

Synthetic Example 10

Into a vessel same to that used in Synthetic Example 1 were charged 77.6 g (0.601 mole) of N-(2-aminoethyl) piperazine and 99.3 g of methanol. Maintaining the inner temperature at 45–55° C., whole of a solution prepared by mixing 87.9 g (0.258 mole) of bisphenol A diglycidyl ether and 66.2 g of acetone beforehand was slowly added dropwise thereto. Then, the reaction and distilling solvent out were conducted according to the same manner as those in Synthetic Example 5. Thereafter, adding 170.3 g of water slowly, the reaction mass was cooled to give a solution of a crosslinked amine compound having a concentration of 50%, pH of 12.7 and a viscosity of 634 mPa.s.

Synthetic Example 11

Into a vessel same to that used in Synthetic Example 1 were charged 73.1 g (0.566 mole) of N-(2-aminoethyl) piperazine and 121.5 g of methanol. Maintaining the inner temperature at 45–55° C., whole of a solution prepared by mixing 82.8 g (0.243 mole) of bisphenol A diglycidyl ether and 34.3 g of acetone beforehand was slowly added dropwise thereto. Then, the reaction and distilling solvent out were conducted according to the same manner as those in Synthetic Example 5. Thereafter, adding 190.0 g of water slowly, the reaction mass was cooled to give a solution of a crosslinked amine compound having a concentration of 50%, pH of 12.8 and a viscosity of 1086 mPa.s.

Paper coating compositions were prepared using the solution of a crosslinked amine compound obtained in Synthetic Examples described above and they were evaluated in the following Examples, in which an aqueous master color having compositions shown in Table 1 and having a solid concentration of 64.5% were used.

TABLE 1

Composition of the Master Color

| Ingredient | Product | Ratio*6 |
|---|---|---|
| Pigment | Ultrawhite 90*1 | 60 parts |
| | Carbital 90*2 | 40 parts |
| Dispersant | Polyacrylate type pigment dispersant*3 | 0.2 part |
| Aqueous Binder | Styrene-butadiene latex*4 | 11 parts |
| | Oxidized starch*5 | 4 parts |

(Footnote for Table 1)
*1Ultrawhite 90: Clay manufactured by Engel Hard Minerals, USA
*2Carbital 90: Calcium carbonate manufactured by Fuji kaolin K.K.
*3, *4 & *5: products available on the market
*6Ratio: Ratio in solid weight Examples 1–11 and Comparison 1–2

In Examples 1–11, to the master color shown in Table 1 were added the solutions of the crosslinked amine compound obtained in Synthetic Examples, respectively, such that the solid content becomes the amount shown in Table 2 or Table 3 per 100 parts of the pigment in said master color.

In Comparison 1, the same manner was repeated except that the crosslinked amine compound obtained in Synthetic Examples was replaced with an aqueous solution of thermosetting polyamidopolyurea formaldehyde resin having a concentration of 50% and prepared according to a method described in Example 3 in JP-A-55-31837 (=U.S. Pat. No. 4,246,153) (this resin is abbreviated with "PAPU" in the Tables).

In Comparison 2, the crosslinked amine compound and other resin were not added to the master color.

The resulting compositions were respectively adjusted to total solid content of 64% and pH of about 9 with water and 10% aqueous sodium hydroxide to give coating compositions. The obtained coating compositions were evaluated in physical properties according to the methods described below and results are shown in Table 2 and Table 3.

(1) pH

Using a glass electrode hydrogen ion concentration meter (manufactured by Toa Dempa Kogyo K.K.), pH of the coating compositions was measured at 25° C. immediately after the preparation.

(2) Viscosity

Using a type B viscometer (model BL, manufactured by K.K. Tokyo Keiki), viscosity of the coating compositions was measured at 60 rpm and 25° C. immediately after the preparation.

The coating compositions was applied respectively on one side of fine papers having a basis weight (US) of 80 g/cm$^2$ with a wire rod to a coating weight of 14 g/cm$^2$. Immediately after the coating, the papers were dried in a hot air at 120° C. for 30 seconds, subjected to moisture conditioning at a temperature of 20° C. and relative humidity of 65% for 16 hours and subjected twice to super calender treatment under conditions of a temperature of 60° C. and of a linear pressure of 60 kg/cm to give coated papers. The obtained coated papers were evaluated in water resistance and ink acceptability according to methods described below. The results are shown in Table 2 and Table 3.

(3) Water Resistance: Wetpick Process (WP Process)

Using an RI testing machine (manufactured by Akira Seisakusho), the coated side was printed after moistening with a water supplying roll and extent of peeling off was evaluated by visual observation. Scoring system and criteria for evaluation were as follows:

Water resistance: (poor) 1–5 (excellent)

(4) Ink Acceptability (4-1) Process A

Using an RI testing machine, the coated side was printed after moistening with a water supplying roll and ink acceptability was evaluated by visual observation. Scoring system and criteria for evaluation were as follows:

Ink acceptability: (poor) 1–5 (excellent)

(4-2) Process B

Using an RI testing machine, after water was poured to the small gap between the metal roll and rubber roll, printing was conducted, and ink acceptability was evaluated by visual observation. Scoring system and criteria for evaluation were as follows:

Ink acceptability: (poor) 1–5 (excellent)

TABLE 2

Test Results in Examples 1–7

| | Example No. | | | | | | |
|---|---|---|---|---|---|---|---|
| | 1 | 2 | 3 | 4 | 5 | 6 | 7 |
| No. of Synthetic Example for the Compound | 1 | 2 | 3 | 4 | 5 | 6 | 7 |
| Amount of the Compound | 0.15 | 0.15 | 0.15 | 0.15 | 0.2 | 0.2 | 0.2 |
| Properties of Coating Composition | | | | | | | |
| pH | 9.5 | 9.5 | 9.6 | 9.3 | 9.6 | 9.7 | 9.6 |
| Viscosity (cP) | 2700 | 2960 | 3150 | 2140 | 2820 | 3800 | 2680 |
| Properties of Coated Paper | | | | | | | |
| Water Resistance: | | | | | | | |
| WP Process | 4.5 | 4.5 | 4.5 | 4.2 | 4.6 | 4.6 | 4.5 |
| Ink Acceptability: | | | | | | | |
| Process A | 4.2 | 4.4 | 4.0 | 3.5 | 4.0 | 4.5 | 4.0 |
| Process B | 4.2 | 4.5 | 4.2 | 3.8 | 4.5 | 4.3 | 4.5 |

TABLE 3

Test Results in Examples 8–11 and Comparison 1–2

| | Example | | | | Comparison | |
|---|---|---|---|---|---|---|
| Example No. | 8 | 9 | 10 | 11 | 1 | 2 |
| No. of Synthetic Example for the Compound | 8 | 9 | 10 | 11 | PAPU | — |
| Amount of the Compound | 0.2 | 0.2 | 0.2 | 0.2 | 0.6 | — |
| Properties of Coating Composition | | | | | | |
| pH | 9.5 | 9.7 | 9.6 | 9.7 | 9.2 | 9.2 |
| viscosity (cP) | 2500 | 3670 | 3890 | 4280 | 2080 | 2060 |
| Properties of Coated Paper | | | | | | |
| Water Resistance: | | | | | | |
| WP Process | 4.7 | 4.7 | 4.5 | 4.7 | 2.4 | 1.3 |
| Ink Acceptability: | | | | | | |
| Process A | 4.5 | 4.5 | 4.6 | 4.4 | 3.0 | 1.5 |
| Process B | 3.8 | 4.4 | 4.5 | 4.4 | 3.0 | 1.5 |

The crosslinked amine compound used in the present invention is not made from formaldehyde. Therefore, the paper coating composition of the present invention does not generate formaldehyde. Further, the paper coating composition can give coated papers with various improved properties including excellent ink acceptability and water resistance.

What is claimed is:

1. A paper coating composition which comprises:

(I) a pigment, (II) an aqueous binder, and (III) a crosslinked amine compound obtainable by reacting a heterocyclic amine (a) and a glycidyl compound (b) having at least two glycidyl groups in the molecule.

2. A paper coating composition according to claim 1, wherein the heterocyclic amine (a) is a compound in which aminoalkyl is attached to a heterocycle having nitrogen as ring atom.

3. A paper coating composition according to claim 1, wherein the heterocyclic amine (a) is N-aminoethylpiperazine or 1,4-bisaminopropylpiperazine.

4. A paper coating composition according to claim 1, wherein the glycidyl compounds (b) is an aromatic glycidyl ethers.

5. A method for preparing a paper coating composition according to claim 1, wherein the cross inked amine compound (III) is used as a solution or a dispersion in a liquid medium, and then mixed with the pigment (I) and an aqueous binder (II).

6. A method according to claim 5, wherein the liquid medium is a mixture of water and an organic solvent.

7. A method according to claim 6, wherein the organic solvent is benzylalcohol.

8. A method according to claim 5, wherein the liquid medium is substantially water.

* * * * *